US005236084A

United States Patent [19]

Evers

[11] Patent Number: 5,236,084

[45] Date of Patent: Aug. 17, 1993

[54] HINGED LID BOX WITH ATTACHED POP-OUT COUPON

[75] Inventor: Donald H. Evers, Richmond, Va.

[73] Assignee: Philip Morris Incorporated, New York, N.Y.

[21] Appl. No.: 825,513

[22] Filed: Jan. 24, 1992

[51] Int. Cl.[5] ..... B65D 85/10

[52] U.S. Cl. ..... 206/273; 206/271; 206/831; 229/160.1

[58] Field of Search ..... 206/268, 271, 273, 831; 229/155, 160.1

[56] References Cited

U.S. PATENT DOCUMENTS

| | | | |
|---|---|---|---|
| 348,924 | 9/1886 | Munson . | |
| 476,765 | 6/1892 | Knapp . | |
| 727,600 | 5/1903 | Doscher . | |
| 1,116,043 | 11/1914 | Elliott | 206/831 |
| 1,967,204 | 7/1934 | Genz | 229/51 |
| 2,265,664 | 12/1941 | Markert | 229/6 |
| 2,338,041 | 12/1943 | King | 229/51 |
| 2,359,679 | 10/1944 | Roehrl | 229/37 |
| 2,415,117 | 2/1947 | Tamarin | 206/41.2 |
| 2,445,001 | 7/1948 | Pence | 206/273 |
| 2,803,394 | 8/1957 | Ringler | 229/44 |
| 2,824,684 | 2/1958 | Ahlers | 229/44 |
| 2,944,555 | 7/1960 | Peel et al. | 206/273 |
| 3,018,878 | 1/1962 | Watkins | 206/41.2 |
| 3,062,430 | 11/1962 | Rutledge | 229/37 |
| 3,102,675 | 9/1963 | Schrom | 229/20 |
| 3,219,253 | 11/1965 | Davis | 229/16 |
| 3,606,135 | 9/1971 | Rosenburg, Jr. | 229/37 |
| 3,625,412 | 12/1971 | Rosenburg, Jr. | 229/39 |
| 3,695,422 | 10/1972 | Tripodi | 206/47 |
| 3,924,740 | 12/1975 | Wood | 206/187 |
| 3,958,744 | 5/1976 | Herglotz | 229/6 |
| 4,042,110 | 8/1977 | Guernsey | 206/459 |
| 4,103,820 | 8/1978 | Mathison et al. | 229/37 |
| 4,108,350 | 8/1978 | Forbes | 229/37 R |
| 4,216,898 | 8/1980 | Davies | 229/44 CB |
| 4,300,676 | 11/1981 | Focke et al. | 206/264 |
| 4,303,155 | 12/1981 | Focke et al. | 206/264 |
| 4,485,926 | 12/1984 | Lenzmeier | 206/602 |
| 4,732,276 | 3/1988 | Knecht | 206/624 |
| 4,742,955 | 5/1988 | Focke et al. | 229/123 |
| 4,753,383 | 6/1988 | Focke et al. | 229/160.1 |
| 4,753,384 | 1/1988 | Focke et al. | 206/273 |
| 4,779,733 | 10/1988 | Kilian | 206/459 |
| 4,784,261 | 11/1988 | Kutchin | 206/256 |
| 4,828,164 | 5/1989 | Passamoni | 229/41 R |
| 4,834,240 | 5/1989 | Dagostine | 206/459 |
| 4,850,482 | 7/1989 | Campbell | 206/273 |
| 4,872,555 | 10/1989 | Shadrach, III et al. | 206/459 |
| 4,942,961 | 7/1990 | Focke et al. | 206/154 |
| 4,948,038 | 8/1990 | Moeller | 206/273 |
| 4,949,841 | 8/1990 | Focke et al. | 206/254 |
| 5,007,578 | 4/1991 | Simone | 229/1.5 B |
| 5,014,906 | 5/1991 | Gero | 229/123 |
| 5,074,462 | 12/1991 | Countee, Jr. | 229/155 |
| 5,137,148 | 11/1992 | Evers | 206/273 |
| 5,160,024 | 11/1992 | Evers | 206/268 |

FOREIGN PATENT DOCUMENTS

| | | | |
|---|---|---|---|
| 643514 | 6/1962 | Canada | 229/160.1 |
| 86985 | 5/1959 | Denmark . | |
| 2047860 | 4/1971 | Fed. Rep. of Germany | 206/831 |
| 2323173 | 11/1973 | Fed. Rep. of Germany | 206/273 |
| 2303720 | 10/1976 | France . | |
| 1572897 | 8/1980 | United Kingdom | 206/273 |

*Primary Examiner*—David T. Fidei
*Attorney, Agent, or Firm*—Fish & Neave

[57] ABSTRACT

A box-like cigarette pack includes a lid with a tab that extends below the bottom of the lid. All or part of the tab may be made readily removable by providing a line of weakness between the removable tab and the remainder of the lid. The tab may be printed or embossed with any desired information and may form a coupon or coupon-like article when removed. Until removed, the tab may be somewhat of an impediment to easy removal of cigarettes or reclosure of the pack, thereby prompting the consumer to remove the tab as intended.

20 Claims, 4 Drawing Sheets

FIG. 1
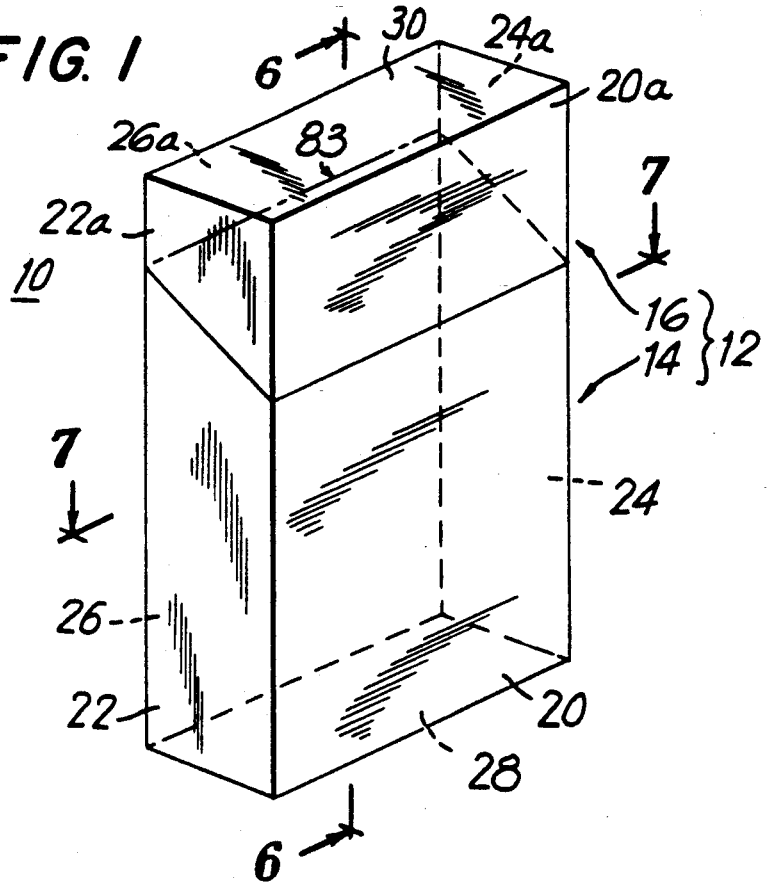
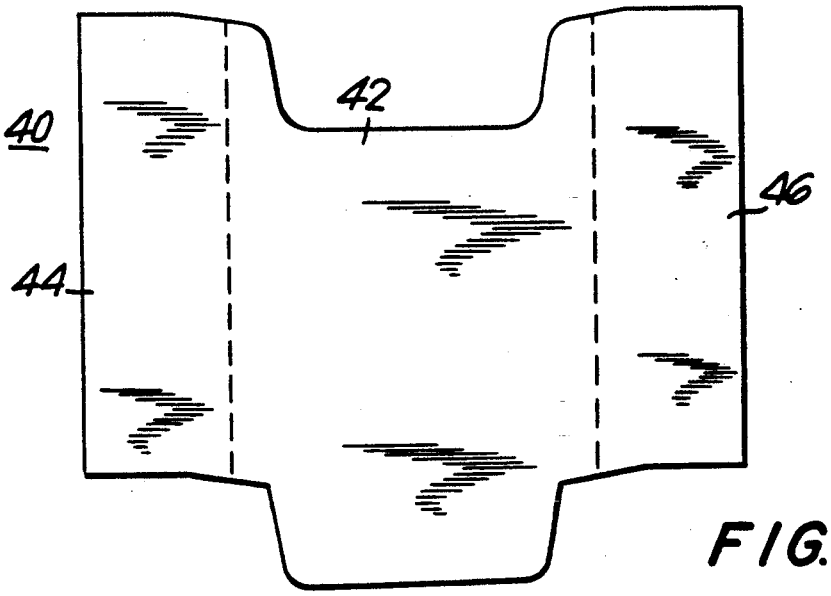
FIG. 2

FIG. 4
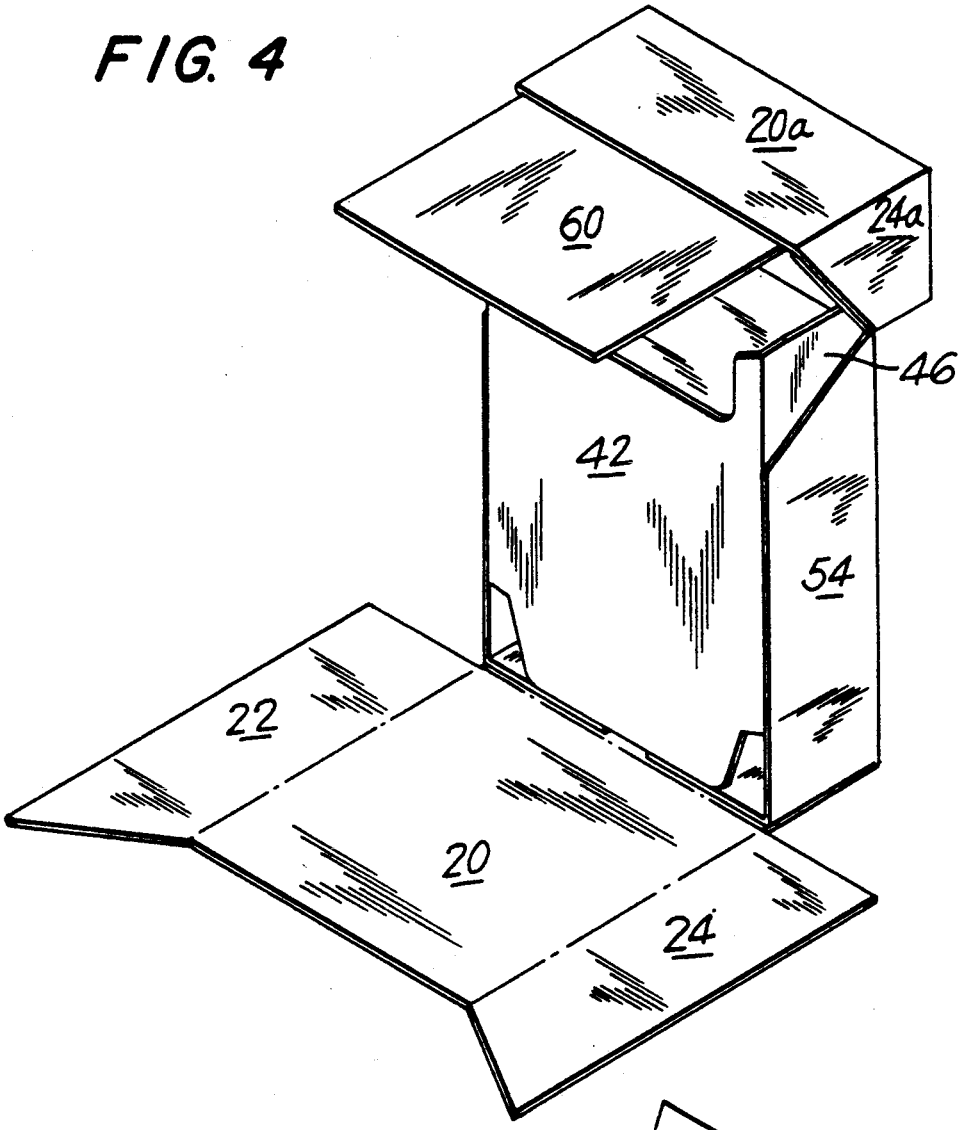
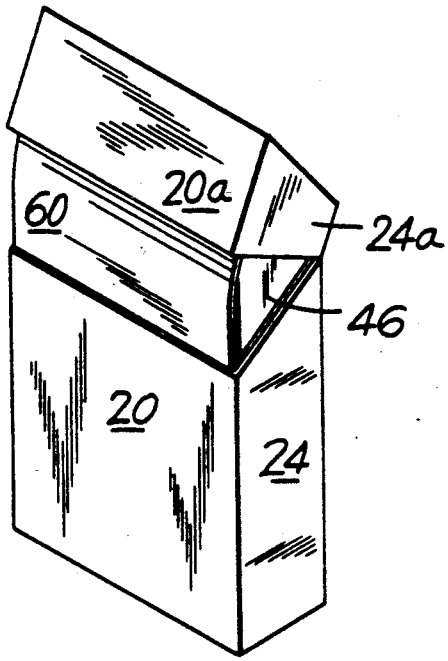
FIG. 5

HINGED LID BOX WITH ATTACHED POP-OUT COUPON

BACKGROUND OF THE INVENTION

This invention relates to cigarette packs, and more particularly to cigarette packs in the form of boxes.

Cigarette packs in the form of boxes are extremely well known. One of the most popular forms of such boxes has an outer member which includes a lower portion in which the cigarettes stand vertically. The upper portion is a lid which is often (although not always) hinged to the back of the lower portion so that the upper ends of the cigarettes are exposed when the lid is tipped back to open the box. Such boxes typically have an innerframe inside the outer member and which extends up from the lower portion under the lid to provide some interference with the lid as it opens and closes. This interference helps to keep the lid firmly and neatly closed and reduces the risk that the lid will open accidentally.

Cigarette packs of the foregoing type are relatively small and strong. The visible exterior surfaces are needed for brand-identifying information, contents specifications and warning labels. There is therefore little or no space on the outside of the pack for additional information such as promotional coupons, and even if such additional information could be put on the outside of the pack, it would be difficult for the consumer to remove that information (such as a coupon) from the pack. Placing coupons or other information separately in the pack is disadvantageous because such placement necessitates additional processing steps, additional production equipment and increased production costs, and the consumer may not notice the information.

It is therefore an object of this invention to provide a cigarette pack having additional surface areas which can be used for a coupon or other information.

It is another object of this invention to provide a cigarette pack including additional information areas which cannot be overlooked by the consumer, but which can be easily removed and either saved or discarded as desired.

It is a further object of this invention to provide a cigarette pack having an additional but removable information area, which pack functions as a standard pack after the additional information area is removed.

SUMMARY OF THE INVENTION

These and other objects of the invention are accomplished in accordance with the principles of the invention by providing a paperboard box-like cigarette pack in which the hinged lid (which may otherwise be substantially conventional) has a tab that extends below the normal front of the lid where the tab cannot fail to be seen by the consumer when the lid of the pack is first opened. All or part of the lid tab is preferably joined to the remainder of the lid by a line of weakness to facilitate removal of the portion of the lid tab beyond the line of weakness. For example, this line of weakness may be formed by perforations and/or partial scoring. The tab provides additional surface area for use as a coupon or for other information. The tab may be printed or embossed on either or both sides with any desired information.

Further features of the invention, its nature and various advantages will be more apparent from the accompanying drawings and the following detailed description of the preferred embodiment.

BRIEF DESCRIPTION OF THE FIGURES

FIG. 1 is an isometric view of a cigarette pack of an illustrative type with which this invention can be employed.

FIG. 2 is a front view of an illustrative innerframe blank that can be used with this invention.

FIG. 4 shows the partially erected blank of FIG. 3 with the illustrative innerframe of FIG. 2 and with the hinged lid pivoted back.

FIG. 5 shows the fully erected blank of FIG. 3 with the hinged lid pivoted back and the lid tab partially inserted inside the lower portion.

DETAILED DESCRIPTION OF THE INVENTION

Figure 3:
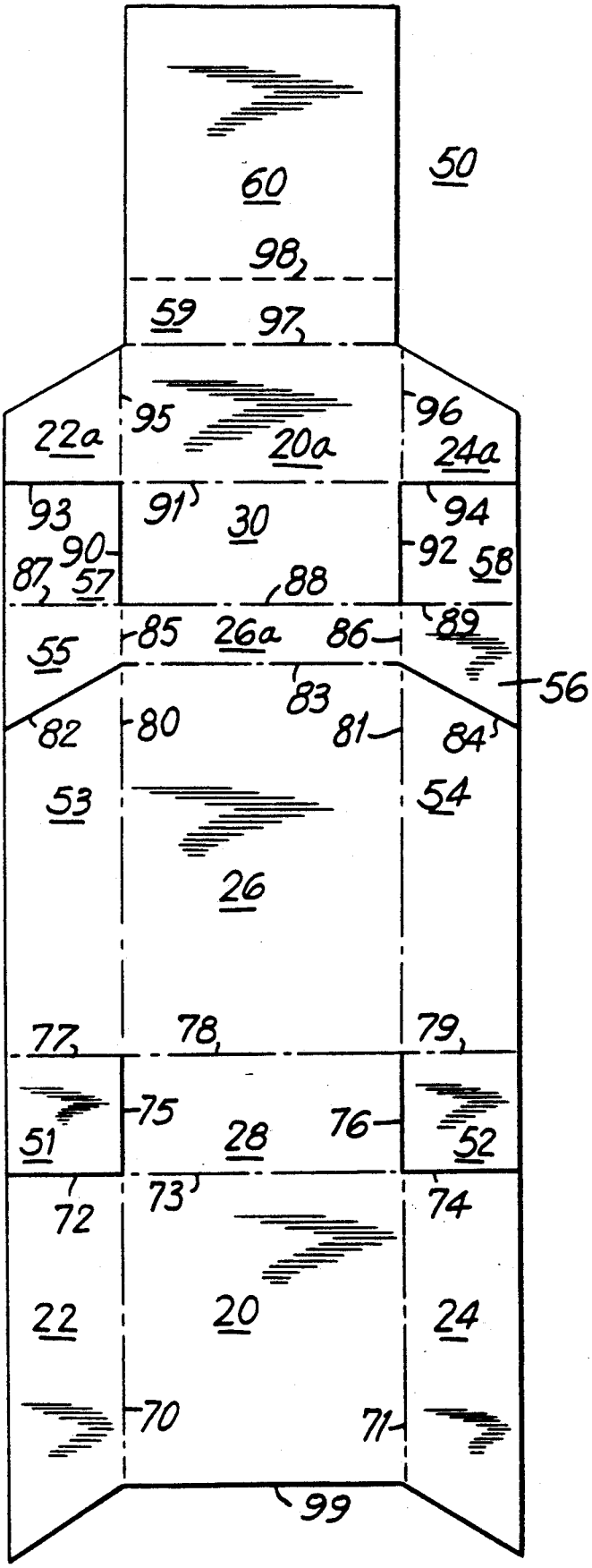
FIG. 3 is a top view of a preferred embodiment of the pack blank according to this invention.
Figure 6:
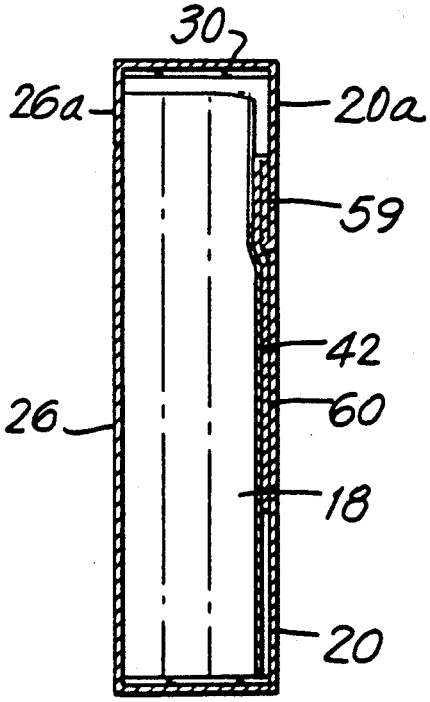
FIG. 6 is a side view of the pack of FIG. 1 with the lid tab inserted between the lower portion and the innerframe.
Figure 7:
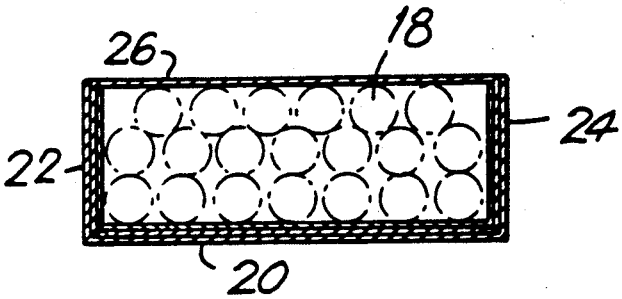
FIG. 7 is a top view of the pack of FIG. 1 with the hinged lid closed.

As shown in FIG. 1, the conventional paperboard, hinged lid, box-type cigarette pack 10 includes an outer member 12 having a lower portion 14 and an upper lid portion 16. Lower portion 14 has a front wall 20, a left side wall 22, a right side wall 24, a rear wall 26, and a bottom wall 28. Lid 16 has similar front **20*a*, left side 22*a*, right side 24*a*, and rear 26*a* walls which respectively function as continuations of the similarly named lower portion walls when the lid 16 is closed as shown in FIG. 1. In addition, lid 16 has a top wall 30. Lid 16 is typically hinged to lower portion 14 along hinge line 83 where rear walls 26 and 26*a* meet one another. When lid 16 is tipped back along hinge line 83, the pack has the appearance shown in FIG. 5**.

FIGS. 2 and 4 reveal the innerframe 40 which is conventionally included inside lower portion 14. Innerframe 40 includes a front wall 42, a left side wall 44, and a right side wall 46. The central upper portion of innerframe front wall 42 has a depression or cutout to facilitate consumer access to the upper ends of the cigarettes 18 in the pack. Typically, cigarettes 18 are initially wrapped in foil inside innerframe 40. The upper front portion of this foil wrapper may be removed by the consumer when he or she opens the pack. Innerframe 40 is typically glued to panels 22 and 24 and/or panel 20. Innerframe front wall 42 need not extend to bottom wall 28 as shown in FIG. 4. When lid 16 is closed, it fits down over and completely covers the portion of innerframe 40 which projects above lower portion 14. Innerframe 40 interferes somewhat with lid 16 as the lid is opened and closed. This interference helps to keep lid 16 neatly closed and reduces the risk of the pack opening by accident.

Cigarette pack 10 is preferably erected from paperboard pack blank 50. The preferred embodiment of blank 50 is shown in FIG. 3 prior to erection with the printed side down. Similar reference numbers are used in FIG. 3 and subsequent FIGS. for elements which are similar or related to elements described above.

Blank 50 includes bottom and top front panels 20 and **20*a*, outside left and right panels 22 and 24, bottom left and right flaps 51 and 52, bottom and top panels 28 and 30, bottom and top rear panels 26 and 26*a*, inside left and right panels 53 and 54, top inside left and right panels 55 and 56, top left and right flaps 57 and 58, top outside left and right panels 22a and 24a, tab connector panel 59, and tab 60**.

Bottom front panel 20 is defined in the longitudinal direction by the separation between parallel bottom front score line 73 and bottom front panel margin 99. Bottom front panel 20 is defined in the lateral direction by first side score line 70 and second side line 71 which connect line 73 and margin 99. Preferably, line 73 is a straight line. Preferably, side score lines 70 and 71 are straight lines, parallel to each other and perpendicular to line 73 and margin 99.

Outside left and right panels 22 and 24 are connected to bottom front panel 20 along lines 70 and 71, respectively. Preferably, the longitudinal and lateral dimensions of outside left panel 22 are equal to the corresponding longitudinal and lateral dimensions of outside right panel 24.

Bottom panel 28 extends from bottom front panel 20 at line 73 to bottom score line 78, and is further defined by first and second cuts 75 and 76. Preferably, line 78 is a straight line, parallel to line 73, and perpendicular to cuts 75 and 76. The longitudinal dimension of bottom panel 28 is substantially equal to the lateral dimensions of outside left and right panels 22 and 24. Preferably, cut 75 is a collinear extension of line 70. Similarly, cut 76 is preferably a collinear extension of line 71.

Bottom rear panel 26 extends from bottom panel 28 at line 78 to hinge line 83, and is further defined by third and fourth side score lines 80 and 81. Preferably, line 83 is a straight line, parallel to line 78, and perpendicular to lines 80 and 81. Preferably, line 80 is a collinear extension of cut 75. Similarly, line 81 is preferably a collinear extension of cut 76. Preferably, the longitudinal dimension of bottom rear panel 26 is greater than the longitudinal dimension of bottom front panel 20, i.e., the distance between lines 78 and 83 is greater than the distance between margin 99 and line 73.

Inside left and right panels 53 and 54 are connected to bottom rear panel 26 along lines 80 and 81, respectively. Inside left panel 53 is defined in the longitudinal direction by left bottom score line 77 and fifth cut 82. Inside right panel 54 is defined in the longitudinal direction by right bottom score line 79 and sixth cut 84. Preferably, the shape and size of inside left panel 53 are substantially equal to the shape and size of outside left panel 22. Similarly, it is preferred that the shape and size of inside right panel 54 are substantially equal to the shape and size of outside right panel 24.

Bottom left flap 51 is connected to inside left panel 53 along line 77, and bottom right flap 52 is connected to inside right panel 54 along line 79. Bottom left flap 51 is defined in the longitudinal direction by third cut 72 and line 77. Bottom right flap 52 is defined in the longitudinal direction by fourth cut 74 and line 79. Preferably, the lateral dimensions of bottom left and right flaps 51 and 52 are slightly less than the longitudinal dimension of bottom panel 28. Preferably, lines 77 and 79 are offset above line 78 by a distance equal to the thickness of paperboard blank 50. These offsets facilitate folding of the flaps and side panels.

Top rear panel 26a extends from bottom rear panel 26 at hinge line 83 to rear score line 88, and is further defined by fifth and sixth side score lines 85 and 86. Preferably, line 88 is a straight line, parallel to hinge line 83, and perpendicular to lines 85 and 86. Preferably, line 85 is a collinear extension of line 80. Similarly, line 86 is preferably a collinear extension of line 81.

Top inside left and right panels 55 and 56 are connected to top rear panel 26a along lines 85 and 86, respectively. Top inside left panel 55 is defined in the longitudinal direction by left rear score line 87 and cut 82. Top inside right panel 56 is defined in the longitudinal direction by right rear score line 89 and cut 84.

Top panel 30 extends from top rear panel 26a at line 88 to top score line 91, and is further defined by seventh and eighth cuts 90 and 92. Preferably, line 91 is a straight line, parallel to line 88, and perpendicular to cuts 90 and 92. The longitudinal dimension of top panel 30 is preferably substantially equal to the longitudinal dimension of bottom panel 28, i.e., the distance between lines 88 and 91 is substantially equal to the distance between lines 73 and 78.

Top left flap 57 is connected to top inside left panel 55 along line 87, and top right flap 58 is connected to top inside right panel 56 along line 89. Top left flap 57 is defined in the longitudinal direction by ninth cut 93 and line 87. Top right flap 58 is defined in the longitudinal direction by tenth cut 94 and line 89. Preferably, the lateral dimensions of top left and right flaps 57 and 58 are slightly less than the longitudinal dimension of top panel 30. Preferably, lines 87 and 89 are offset below line 88 by a distance equal to the thickness of paperboard blank 50. These offsets facilitate folding of the flaps and side panels.

Top front panel 20a extends from top panel 30 at line 91 to top front score line 97, and is further defined by seventh and eighth side score lines 95 and 96. Preferably, line 97 is a straight line, parallel to line 91, and perpendicular to lines 95 and 96. Preferably, line 95 is a collinear extension of cut 90. Similarly, line 96 is preferably a collinear extension of cut 92. Preferably, the longitudinal dimension of top front panel 20a is greater than the longitudinal dimension of top rear panel 26a, i.e., the distance between lines 91 and 97 is greater than the distance between lines 83 and 88.

Top outside left and right panels 22a and 24a are connected to top front panel 20a along lines 95 and 96, respectively. Preferably, the shape and size of top outside left panel 22a are substantially equal to the shape and size of top inside left panel 55. Similarly, it is preferred that the shape and size of top outside right panel 24a are substantially equal to the shape and size of top inside right panel 56.

Tab connector panel 59 extends from top front panel 20a at line 97 to tab score line 98. Preferably, line 98 is a straight line, parallel to line 97.

Tab 60 extends from tab connector panel 59 at line 98. Preferably, line 98 is formed by perforations and/or partial scoring to facilitate detachment and removal of tab 60.

The blank 50 shown in FIG. 3 is erected to form the carton 10 shown in FIG. 1. As shown in FIG. 4, tab 60 and tab connector panel 59 are folded along top front score line 97 so that tab 60 and tab connector panel 59 are parallel to top front panel 20a, top panel 30 and top rear panel 26a. Tab 60 is then folded back along tab score line 98 so that tab 60 is parallel to tab connector panel 59.

Top left flap 57 and top inside left panel 55 are erected perpendicular to top panel 30 and top rear panel 26a by folding along fifth side score line 85. Similarly, top right flap 58 and top inside right panel 56 are erected perpendicular to top panel 30 and top rear panel 26a by folding along sixth side score line 86. Top left flap 57 is erected perpendicular to top inside left panel 55 by folding along left rear score line 87. Similarly, top right flap 58 is erected perpendicular to top inside right panel 56 by folding along right rear score line 89.

Inside left panel 53 and bottom left flap 51 are erected perpendicular to bottom rear panel 26 and bottom panel 28 by folding along third side score line 80. Similarly, inside right panel 54 and bottom right flap 52 are erected perpendicular to bottom rear panel 26 and bottom panel 28 by folding along fourth side score line 81. Bottom left flap 51 is erected perpendicular to inside left panel 53 by folding along left bottom score line 77. Similarly, bottom right flap 52 is erected perpendicular to inside right panel 54 by folding along right bottom score line 79.

Top panel 30, top front panel 20a, tab connector panel 59, tab 60, and top outside left and right panels 22a and 24a are erected perpendicular to top rear panel 26a by folding along rear score line 88.

Bottom panel 28, bottom front panel 20, and outside left and right panels 22 and 24 are erected perpendicular to bottom rear panel 26 by folding along bottom score line 78.

Top front panel 20a, tab connector panel 59, tab 60, and top outside left and right panels 22a and 24a are erected perpendicular to top panel 30 by folding along top score line 91.

Bottom front panel 20, and outside left and right panels 22 and 24 are erected perpendicular to bottom panel 28, and bottom front panel 20 is erected parallel to tab 60, by folding along bottom front score line 73.

Top outside left panel 22a is erected perpendicular to top front panel 20a, and parallel to contiguous top inside left panel 55, by folding along seventh side score line 95. Similarly, top outside right panel 24a is erected perpendicular top front panel 20a, and parallel to contiguous top inside right panel 56, by folding along eighth side score line 96.

Outside left panel 22 is erected perpendicular to bottom front panel 20, and parallel to contiguous inside left panel 53, by folding along first side score line 70. Similarly, outside right panel 24 is erected perpendicular to bottom front panel 20, and parallel to contiguous inside right panel 54, by folding along second side score line 71.

Preferably, outside left panel 22 is adhesively attached to inside left panel 53, outside right panel 24 is adhesively attached to inside right panel 54, top outside left panel 22a is adhesively attached to top inside left panel 55, top outside right panel 24a is adhesively attached to top inside right panel 56, and top connector panel 59 is adhesively attached to top front panel 20a.

Innerframe 40 is preferably glued inside the lower portion 14 of pack 10 (e.g., by gluing innerframe panels 44 and 46 to pack side walls 53 and 54, respectively).

As shown in FIGS. 4 and 5, lid 16 has a tab 60 that extends below the front of the lid. When the pack is closed, tab 60 is preferably positioned between the front wall 20 and innerframe front wall 42. Tab 60 also can be positioned between innerframe front wall 42 and cigarettes 18. In the preferred embodiment having a hinged lid, when the pack is opened by tipping back lid 16 along hinge line 83, tab 60 "pops out" and is noticeably visible to the consumer. Preferably, all or part of tab 60 is detachably attached to the lid 16 by a line of weakness 98 to facilitate removal of tab 60. Tab 60 extends down from lid 16 where tab 60 is (1) clearly visible, (2) easily grasped for removal, and (3) a possible impediment to easy withdrawal of the first cigarette until removed. Tab 60 can be as wide as, or less wide than, lid 16.

One or both sides of tab 60 may be printed or embossed with any desired information. Preferably this information is visible to the consumer when the pack lid is first opened. The information may include a suggestion that the consumer remove tab 60 from the pack. When that is done, additional information on tab 60, e.g., printed on the reverse side of tab 60, may become visible to the consumer. The removed tab may be a convenient size and shape for a coupon or coupon-like article. By projecting down from lid 16, tab 60 is highly visible to the consumer when the pack is opened, and the consumer is encouraged to remove tab 60 because, until removed, tab 60 tends to interfere with the usual easy removal of cigarettes from the pack and reclosure of the pack.

Printing or embossing may be placed on tab 60 at any time (e.g., before or after pack blank 50 is cut to its final individual shape). A special eye mark may be included in printing applied prior to cutting to help register the cutting with the printing.

Although FIGS. 4 and 5 shows the pack with lid 16 partially open, it will be appreciated that the lid opens and closes exactly as described above. As in the prior art, when the lid of the pack shown in FIG. 1 is closed, the outer member of the pack completely encloses and obscure tab 60. Accordingly when the pack of FIG. 5 is closed, it looks exactly as shown in FIG. 1.

When the consumer of a pack having a tab 60 of the type shown in FIGS. 4 and 5 first begins to open the pack, the consumer sees what is shown in FIG. 5. In order to most conveniently remove a cigarette from the pack, the consumer must first remove tab 60. This may be made especially apparent to the consumer by printing instructions on tab 60 or elsewhere on the pack. After tab 60 has been removed, the pack is thereafter functionally the same as a conventional pack.

Although tab 60 is shown in the drawings as a rectangle, it will be appreciated that it can have other shapes such as a scalloped edge, a rounded edge, or an arrowhead shaped edge. It also will be appreciated that tab 60 can have one or more holes or openings. Further, tab 60 can have one or more internal portions detachably attached to tab 60.

The dimensions of pack blank 50, and the dimensions of the panels and flaps comprising pack blank 50, are determined by the number, circumference and length of cigarettes to be packed in the erected pack 10.

Although FIG. 3 shows tab 60 attached to tab connector panel 59 along tab score line 98, it will be appreciated that another embodiment of the invention could eliminate tab connector panel 59. Thus, tab 60 could be attached to top front panel 20a along a line formed by perforations and/or partial scoring to facilitate detachment and removal of tab 60. This embodiment would otherwise function the same as the preferred embodiment.

The machine components used in the construction and erection of cigarette packs from paperboard blanks are well known in the art, and a discussion of the combination of machine components used to construct and erect packs of the present invention is not necessary to understand the present invention.

It will be understood that the foregoing is merely illustrative of the principles of this invention, and that various changes and modifications to the preferred embodiment can be made to provide other embodiments also contemplated by the invention and without departing from the scope and spirit of the invention. Accordingly, it is not intended that the invention be limited except by the appended claims. For example, lid 16 may be either integral with main portion 14 or glued to lower portion 14 by a flap. The lid of the pack may also slide on and off over the innerframe 40 rather than pivoting open and closed. Further, the principles of this invention can be applied to packs and pack components constructed of materials other than conventional paperboard. Further, it will be appreciated that the appended claims define cigarette packs in a conventional, upright orientation, as shown in FIGS. 1 and 5. Although cigarette packs of this invention can be inverted, turned on their side, or placed in any number of orientations, the appended claims define components of cigarette packs relative to other components when the cigarette packs are in a conventional, upright orientation. This convention is adopted for the sake of clarity and is not a limitation on the scope of the appended claims.

What is claimed is:

1. A cigarette pack for containing cigarettes having first ends adjacent a first end of the cigarette pack and second ends adjacent a second end of the cigarette pack, the cigarette pack comprising:

(a) an outer member including a bottom front wall having an upper edge which is below the first ends of the cigarettes and a bottom edge adjacent the second end of the cigarette pack;

(b) a lid member having a bottom front edge positioned adjacent the upper edge of the outer member's bottom front wall when the lid member is closed so that the cigarettes contained in the pack are inaccessible;

(c) an innerframe member including a front wall partly disposed inside the outer member front wall;

(d) the innerframe member front wall having an upper edge which is above the upper edge of said outer member front wall, but below the first ends of the cigarettes;

(e) a tab extending from the lid member's bottom front edge; and (f) all or part of the tab detachably attached to the lid member's bottom front edge along a line of weakness.

2. The cigarette pack defined in claim 1 wherein the tab further comprises a tab connector panel connected to the lid member's bottom front edge along a score line and the tab is joined to the tab connector panel along a line which has been weakened to facilitate removal of the tab from the pack.

3. The cigarette pack defined in claim 1 wherein the tab is printed with predetermined indicia.

4. The cigarette pack defined in claim 1 wherein the cigarettes are wrapped in a foil wrapper inside of the innerframe member, the foil wrapper having a removable upper portion.

5. The cigarette pack defined in claim 1 wherein the tab is disposed between the outer member front wall and the innerframe member front wall when the lid member is closed by fitting the lid member over the innerframe member and the first ends of the cigarettes so that the cigarettes contained in the pack are inaccessible.

6. The cigarette pack defined in claim 1 wherein the lid member fits over the part of the innerframe member which extends above said upper edge of said outer member front wall and which closes said pack when said lid member is closed.

7. The cigarette pack defined in claim 6 wherein the lid member completely covers the part of the innerframe member which extends above the upper edge of the outer member when the lid member is closed.

8. The cigarette pack defined in claim 7 wherein the outer member further includes a rear wall opposite the outer member front wall, and wherein the lid member is hinged to the rear wall.

9. The cigarette pack defined in claim wherein the outer member further includes left and right side walls, extending respectively from left and right side edges of said outer member front wall toward the rear of said pack, and wherein the innerframe member includes left and right side panels, extending respectively from left and right side edges of the innerframe front wall toward the rear of the pack and respectively partly disposed inside the left and right side walls.

10. A blank for forming a cigarette pack, the blank comprising:

(a) a bottom front panel defined by a bottom front score line, a bottom panel margin parallel to the bottom front score line, and first and second side score lines transverse of the bottom front score line and the bottom front panel margin;

(b) an outside left panel connected to the bottom front panel along the first side score line;

(c) an outside right panel connected to the bottom front panel along the second side score line;

(d) a bottom panel connected to the bottom front panel along the bottom front score line, and further defined by a bottom score line parallel to the bottom front score line, and first and second cuts transverse of the bottom front score line and the bottom score line;

(e) a bottom rear panel connected to the bottom panel along the bottom score line, and further defined by a hinge line parallel to the bottom score line, and third and fourth side score lines transverse of the hinge line and the bottom score line;

(f) an inside left panel connected to the bottom rear panel along the third side score line, and further defined by a left bottom score line transverse of the third side score line;

(g) an inside right panel connected to the bottom rear panel along the fourth side score line, and further defined by a right bottom score line transverse of the fourth side score line;

(h) a top rear panel connected to the bottom rear panel along the hinge line, and further defined by a rear score line parallel to the hinge line, and fifth and sixth score lines transverse of the hinge line and the rear score line;

(i) a top inside left panel connected to the top rear panel along the fifth side score line, and further defined by a left rear score line and a fifth cut, both transverse of the fifth side score line;

(j) a top inside right panel connected to the top rear panel along the sixth side score line, and further defined by a right rear score line and a sixth cut, both transverse of the sixth side score line;

(k) a top panel connected to the top rear panel along the rear score line, and further defined by a top score line parallel to the rear score line, and seventh and eighth cuts transverse of the rear score line and the top score line;

(l) a top front panel connected to the top panel along the top score line, and further defined by a top front score line parallel to the top score line, and seventh and eighth side score lines transverse of the top score line and the top front score line;

(m) a top outside left panel connected to the top front panel along the seventh side score line;

(n) a top outside right panel connected to the top front panel along the eighth side score line;

(o) a tab connector panel connected to the top front panel along the top front score line, and further defined by a tab score line parallel to the top front score line;

(p) a tab connected to the tab connector panel along the tab score line; and (q) the tab is longer than the top front panel in the direction perpendicular to the top front score line.

11. The blank of claim 10 further comprising a top left flap connected to the top inside left panel along the left rear score line.

12. The blank of claim 11 further comprising a top right flap connected to the top inside right panel along the right rear score line.

13. The blank of claim 10 further comprising a bottom left flap connected to the inside left panel along the left bottom score line.

14. The blank of claim 13 further comprising a bottom right flap connected to the inside right panel along the right bottom score line.

15. A blank for forming a cigarette pack, the blank comprising:

(a) a bottom front panel defined by a bottom front score line, a bottom front panel margin parallel to the bottom front score line, and first and second side score lines transverse of the bottom front score line and the bottom front panel margin;

(b) an outside left panel connected to the bottom front panel along the first side score line;

(c) an outside right panel connected to the bottom front panel along the second side score line;

(d) a bottom panel connected to the bottom front panel along the bottom front score line, and further defined by a bottom score line parallel to the bottom front score line, and first and second cuts transverse of the bottom front score line and the bottom score line;

(e) a bottom rear panel connected to the bottom panel along the bottom score line, and further defined by a hinge line parallel to the bottom score line, and third and fourth side score lines transverse of the hinge line and the bottom score line;

(f) an inside left panel connected to the bottom rear panel along the third side score line, and further defined by a left bottom score line transverse of the third side score line;

(g) an inside right panel connected to the bottom rear panel along the fourth side score line, and further defined by a right bottom score line transverse of the fourth side score line;

(h) a top rear panel connected to the bottom rear panel along the hinge line, and further defined by a rear score line parallel to the hinge line, and fifth and sixth score lines transverse of the hinge line and the rear score line;

(i) a top inside left panel connected to the top rear panel along the fifth side score line, and further defined by a left rear score line and a fifth cut, both transverse of the fifth side score line;

(j) a top inside right panel connected to the top rear panel along the sixth side score line, and further defined by a right rear score line and a sixth cut, both transverse of the sixth side score line;

(k) a top panel connected to the top rear panel along the rear score line, and further defined by a top score line parallel to the rear score line, and seventh and eighth cuts transverse of the rear score line and the top score line;

(l) a top front panel connected to the top panel along the top score line, and further defined by a top front score line parallel to the top score line, and seventh and eighth side score lines transverse of the top score line and the top front score line;

(m) a top outside left panel connected to the top front panel along the seventh side score line;

(n) a top outside right panel connected to the top front panel along the eighth side score line;

(o) a tab connected to the top front panel along the top front score line; and (p) said tab is longer than said top front panel in the direction perpendicular to the top front score line.

16. The blank of claim 15 further comprising a top left flap connected to the top inside left panel along the left rear score line.

17. The blank of claim 16 further comprising a top right flap connected to the top inside right panel along the right rear score line.

18. The blank of claim 15 further comprising a bottom left flap connected to the inside left panel along the left bottom score line.

19. The blank of claim 18 further comprising a bottom right flap connected to the inside right panel along the right bottom score line.

20. The cigarette pack defined in claim 5 wherein the tab is slideably withdrawable from between the outer member front wall and the innerframe member front wall as said lid member is opened.

* * * * *